US011112720B2

(12) United States Patent
Ogawara

(10) Patent No.: US 11,112,720 B2
(45) Date of Patent: Sep. 7, 2021

(54) TECHNIQUE FOR TRANSMITTING SIGNAL INDICATING ABNORMALITY IN IMAGE FORMING APPARATUS

(71) Applicant: CANON KABUSHIKI KAISHA, Tokyo (JP)

(72) Inventor: Satoshi Ogawara, Koshigaya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/928,272

(22) Filed: Jul. 14, 2020

(65) Prior Publication Data

US 2021/0026270 A1 Jan. 28, 2021

(30) Foreign Application Priority Data

Jul. 25, 2019 (JP) ..... JP2019-137079

(51) Int. Cl.
*G03G 15/00* (2006.01)
*G03G 15/02* (2006.01)

(52) U.S. Cl.
CPC ..... *G03G 15/0258* (2013.01); *G03G 15/0291* (2013.01)

(58) Field of Classification Search
CPC ..... G03G 15/0258; G03G 15/0291; G03G 15/0283
USPC ..... 399/31, 100
See application file for complete search history.

(56) References Cited

U.S. PATENT DOCUMENTS 10,691,040 B2 * 6/2020 Katoh ..... G03G 15/0258
10,890,855 B2 * 1/2021 Shiraki et al. ..... G03G 15/0266

FOREIGN PATENT DOCUMENTS

JP 2000-330431 A 11/2000

* cited by examiner

*Primary Examiner* — William J Royer
(74) *Attorney, Agent, or Firm* — Venable LLP

(57) ABSTRACT

An image forming unit forms an image on a sheet. A first generation circuit generates, regarding a member involved in image formation in the image forming unit, a first signal relating to a first abnormality. A second generation circuit generates, regarding the member, a second signal that relates to a second abnormality different from the first abnormality, and whose feature in a time axis direction or a frequency axis direction is different from that of the first signal. A control circuit has a single port to which the first signal and the second signal are to be input. The control circuit identifies between the first signal and the second signal based on a feature of a signal input to the port.

20 Claims, 12 Drawing Sheets

TECHNIQUE FOR TRANSMITTING SIGNAL INDICATING ABNORMALITY IN IMAGE FORMING APPARATUS

BACKGROUND OF THE INVENTION

Field of the Invention

The present invention relates to a technique for transmitting a signal indicating an abnormality in image forming apparatuses.

Description of the Related Art

In an electrophotographic image forming apparatus, members involved in image formation may need to be cleaned or replaced. For example, when a paper dust or toner is attached to a charger that performs corona discharge, a leakage discharge may occur between the charger and a photosensitive body. According to Japanese Patent Laid-Open No. 2000-330431, an overcurrent protection circuit is proposed for suppressing, upon detecting a leakage current, the leakage current from continuously flowing. The likelihood of occurrence of such leakage discharge can be reduced by cleaning a wire for corona discharge.

Incidentally, a charger also has a design life, and therefore the charger whose lifetime has expired needs to be replaced. For example, a wire whose lifetime has expired may break due to corona discharge. According to Japanese Patent Laid-Open No. 2000-330431, a leakage current can be detected by a current detection circuit, but a circuit for detecting breakage of a wire is not provided. Therefore, if a circuit for detecting breakage of a wire is added, a maintenance staff member may be able to easily determine which of the cleaning of a charger and the replacement of the charger is required. However, a controller needs to have two input ports for receiving detection signals respectively output from the two circuits. In order to add a port to a CPU (Central Processing Unit) or an ASIC (Application Specific Integrated Circuit) of the controller, the CPU or the ASIC needs to be entirely revised, and as a result, the manufacturing cost noticeably increases.

SUMMARY OF THE INVENTION

The present invention provides an image forming apparatus comprising the following elements. An image forming unit forms an image on a sheet. A first generation circuit generates, regarding a member involved in image formation in the image forming unit, a first signal relating to a first abnormality. A second generation circuit generates, regarding the member, a second signal that relates to a second abnormality different from the first abnormality, and whose feature in a time axis direction or a frequency axis direction is different from that of the first signal. A control circuit has a single port to which the first signal and the second signal are to be input. The control circuit identifies between the first signal and the second signal based on the feature of a signal input to the port.

Further features of the present invention will become apparent from the following description of exemplary embodiments (with reference to the attached drawings).

BRIEF DESCRIPTION OF THE DRAWINGS

FIG. 4 is a diagram illustrating waveforms of a charging voltage and the like.

FIGS. 6A and 6B are diagrams illustrating a detection signal and the like.

FIGS. 9A and 9B are diagrams illustrating waveforms of the detection signal and the like.

DESCRIPTION OF THE EMBODIMENTS

Figure 1:
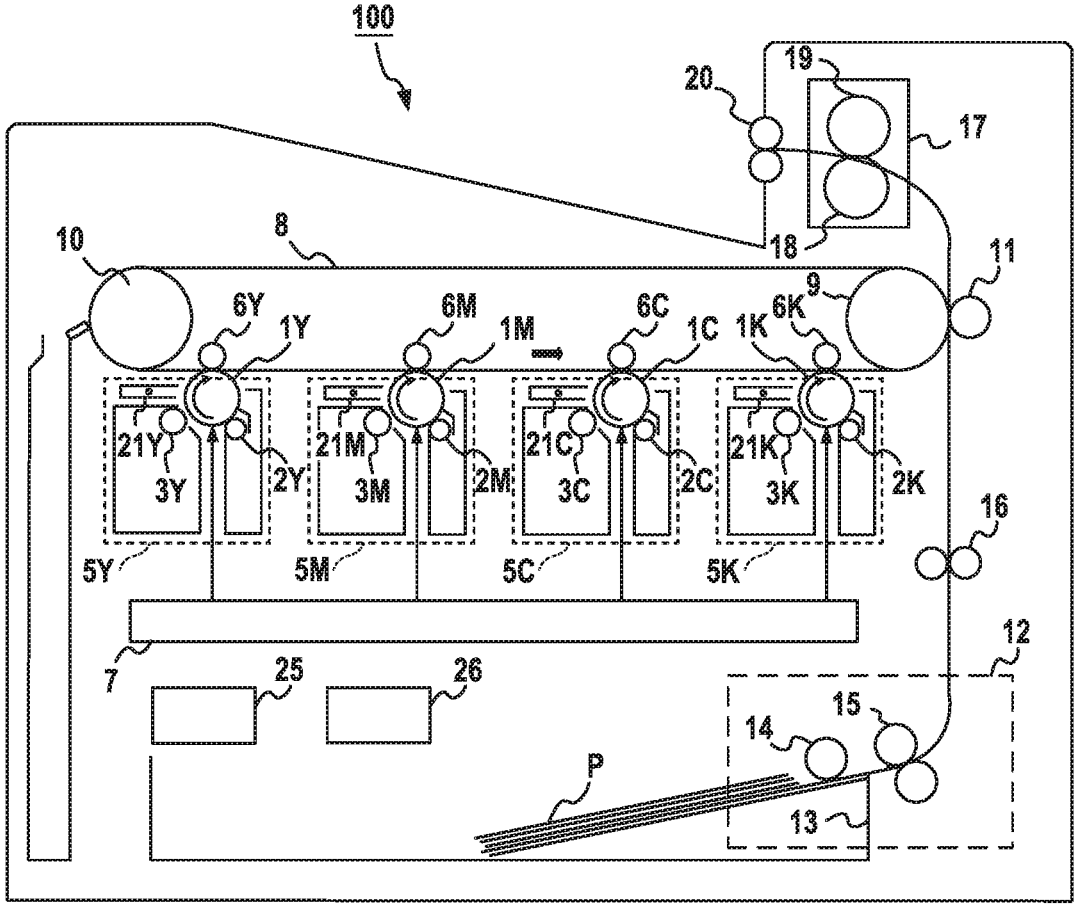
FIG. 1 is a diagram illustrating an image forming apparatus.

An image forming apparatus according to an embodiment of the present invention will be described as an example. An image forming apparatus 100 shown in FIG. 1 includes process cartridges 5Y, 5M, 5C, and 5K that can be attached to and detached from a body thereof. The four process cartridges 5Y, 5M, 5C, and 5K have the same structure, but differs differ in that images are formed by toner of different colors, namely yellow (Y), magenta (M), cyan (C), and black (K). Hereinafter, the signs of Y, M, C, and K will be omitted unless a description regarding an individual color will be given.

The process cartridge 5 includes a photosensitive drum 1, which is an image carrier, a charging roller 2, which is a charger, and a developing roller 3, which is a developing device. A laser unit 7 provided below the process cartridges 5 is an optical system control unit that controls driving/stopping of a scanner motor and emission of a laser beam in accordance with instructions from a controller 25. The photosensitive drum 1 is charged to a predetermined negative potential by the charging roller 2, and thereafter, an electrostatic latent image is formed thereon by a laser beam. The electrostatic latent image is subjected to reversal development performed by the developing roller 3, and toner of negative polarity is attached thereon, and as a result, a toner image is formed on the photosensitive drum 1.

An intermediate transfer belt unit includes an intermediate transfer belt 8 and a driving roller 9 that drives the intermediate transfer belt 8, and a driven roller 10 that rotates following the movement of the intermediate transfer belt 8. The intermediate transfer belt 8 is a belt-like intermediate transfer body, but a drum-like intermediate transfer body may also be adopted. A primary transfer roller 6 is provided inside the intermediate transfer belt 8 so as to oppose the photosensitive drum 1. A toner image formed on the photosensitive drum 1 is transferred on the intermediate transfer belt 8 by the primary transfer roller 6. A multicolor toner image formed by transferring toner images of four colors on the intermediate transfer belt 8 in an overlaid manner is conveyed to a secondary transfer roller 11.

A feeding apparatus 12 includes a sheet feeding roller 14 that feeds a sheet P from a sheet feeding cassette 13 that stores sheets P and a conveyance roller pair 15 that conveys a fed sheet P. The sheet P conveyed from the feeding apparatus 12 is conveyed to the secondary transfer roller 11 by a registration roller pair 16. The secondary transfer roller 11 transfers the toner image on the intermediate transfer belt 8 to the conveyed sheet P. The sheet P on which the toner image has been transferred is conveyed to a fixing apparatus 17, and the toner image is fixed on a surface of the sheet P by applying heat and pressure by a fixing film 18 and a pressure roller 19. The sheet P on which the toner image has been fixed is discharged by a sheet discharging roller pair 20.

A post charger 21 is a charger that is supplied with a post charging voltage from a power supply apparatus 26. The post charger 21 has a wire, and as a result of the post charging voltage being applied to the wire, corona discharge occurs between the wire and the photosensitive drum 1. With this, the charge amount of toner on the photosensitive drum 1 is kept at a charge amount in a target range. According to FIG. 1, the post charger 21 is provided with respect to each of the Y, M, C, and K colors, but the configuration may also be such that the post charger 21 is only provided with respect to the black color.

Controller and Power Supply Apparatus

Figure 2:
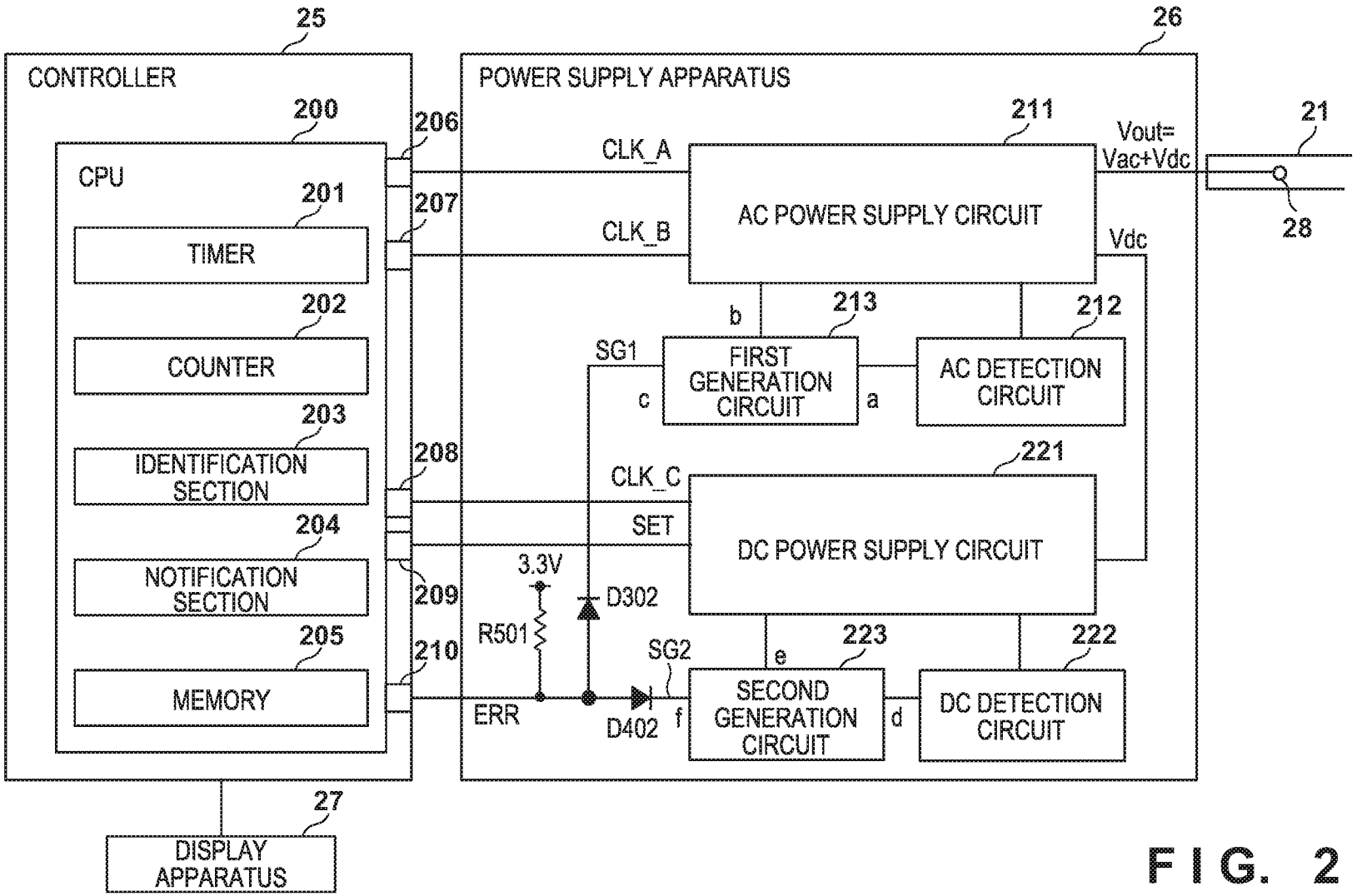
FIG. 2 is a diagram illustrating a controller and a power supply apparatus.

FIG. 2 illustrates the controller 25 and the power supply apparatus 26. The controller 25 includes a CPU 200, and integrally controls the units of the image forming apparatus 100. The CPU 200 controls the image forming apparatus 100 by executing a control program stored in a ROM region of a memory 205. The CPU 200 is a processor circuit that functions as a timer 201, a counter 202, an identification section 203, and a notification section 204 by executing the control program. Some of or all of these functions may be realized by hardware such as ASIC or FPGA. ASIC is an acronym of application specific integrated circuit. FPGA is an acronym of field programmable gate array. The timer 201 is a clocking circuit that measures a predetermined time. The counter 202 is a counting circuit that counts a number of pulses or the like. The identification section 203 is a circuit that identifies between a plurality of signals output from the power supply apparatus 26. The notification section 204 is a circuit that causes a display apparatus 27 to display information such as a message corresponding to a signal identified by the identification section 203. The CPU 200 generates and outputs a plurality of driving signals CLK_A, CLK_B, and CLK_C for driving the power supply apparatus 26 and a setting signal SET. An output port 206 is for outputting the driving signal CLK_A. An output port 207 is for outputting the driving signal CLK_B. An output port 208 is for outputting the driving signal CLK_C. An output port 209 is for outputting the setting signal SET. An input port 210 is for receiving an error signal ERR, which is one of a first signal SG1 and a second signal SG2, from the power supply apparatus 26. The identification section 203 identifies between the first signal SG1 and the second signal SG2 based on the feature of the first signal SG1 and the feature of the second signal SG2. Here, the feature refers to a signal feature in a time axis direction or a frequency axis direction. For example, the feature is a period of a signal, a number of pulses in a predetermined period, or the like.

The power supply apparatus 26 generates a charging voltage Vout to be applied to a wire 28 of the post charger 21. Here, the charging voltage Vout is generated by superimposing a charging DC voltage Vdc on a charging AC voltage Vac. The configuration may be such that the an AC power supply circuit 211 generates the charging AC voltage Vac according to the driving signals CLK_A and CLK_B, and generates the charging voltage Vout by superimposing the charging AC voltage Vac on the charging DC voltage Vdc output from the an DC power supply circuit 221. An AC detection circuit 212 is a circuit that detects an AC current that the AC power supply circuit 211 supplies to a load (post charger 21). A first generation circuit 213 detects whether or not an overcurrent occurs (whether or not a leakage current occurs) based on the AC current detected by the AC detection circuit 212. The first generation circuit 213 outputs the first signal SG1 indicating that an overcurrent has been detected to the CPU 200. Upon detecting an overcurrent, the first generation circuit 213 may restrict the operation of the AC power supply circuit 211 (overcurrent protection).

The DC power supply circuit 221 generates the charging DC voltage Vdc to be applied to the wire 28 of the post charger 21 based on the driving signal CLK_C and the setting signal SET that are output from the CPU 200. The DC voltage value is determined by the setting signal SET. A DC detection circuit 222 detects a DC voltage to be applied to a load (wire 28). A second generation circuit 223 detects whether or not an overvoltage occurs (whether or not the wire 28 is broken) based on the DC voltage detected by the DC detection circuit 222. The second generation circuit 223 generates the second signal SG2 indicating that an overvoltage has occurred, and outputs the second signal SG2 to the CPU 200. If an overvoltage has occurred, the second generation circuit 223 may restrict the operation of the DC power supply circuit 221 (overvoltage protection).

When the identification section 203 recognizes that the first signal SG1 is input to the input port 210, the notification section 204 may output a message (e.g., error code) indicating that a first maintenance is needed with respect to the post charger 21 to the display apparatus 27. This message may also be a message indicating that a leakage current has occurred in the wire 28. Also, the first maintenance may also be cleaning of the post charger 21.

When the identification section 203 recognizes that the second signal SG2 is input to the input port 210, the notification section 204 may output a message (e.g., error code) indicating that a second maintenance is needed with respect to the post charger 21 to the display apparatus 27. This message may also be a message indicating that breakage of the wire 28 has occurred. Also, the second maintenance may also be repair or replacement of the post charger 21.

Note that the first signal SG1 is input to the input port 210 through a diode D302. Specifically, a cathode of the diode D302 is connected to the first generation circuit 213. An anode of the diode D302 is connected to an anode of a diode D402, the input port 210, and one end of a pull-up resistor R501. The other end of the pull-up resistor R501 is connected to a 3.3 V power supply. The second signal SG2 is input to the input port 210 through the diode D402. Specifically, a cathode of the diode D402 is connected to the second generation circuit 223. The anode of the diode D402 is connected to the anode of the diode D302, the input port 210, and the one end of the pull-up resistor R501. The diode D302 restricts the second signal SG2 from being applied to the first generation circuit 213. The diode D402 restricts the first signal SG1 from being applied to the second generation circuit 223. The input port 210 is connected to the 3.3 V power supply through the pull-up resistor R501. That is, when a detection signal is not input to the input port 210, the level of the input port 210 is kept at a high level. In the following, the detection signal to be applied to the input port 210 is denoted by an error signal ERR. The error signal ERR is the first signal SG1 or the second signal SG2.

Embodiment 1

AC Power Supply Circuit

Figure 3:
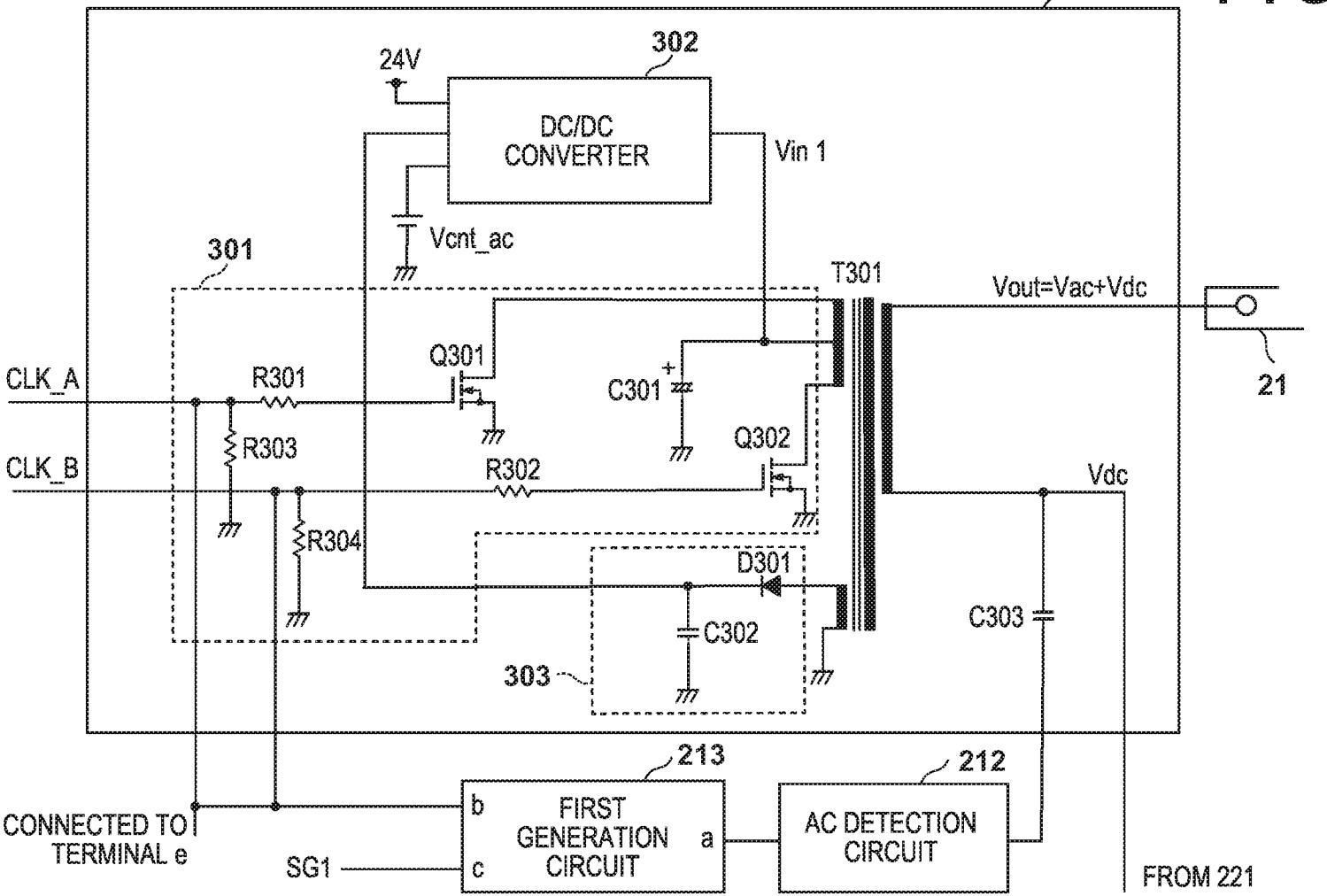
FIG. 3 is a diagram illustrating an AC power supply circuit.
Figure 4:
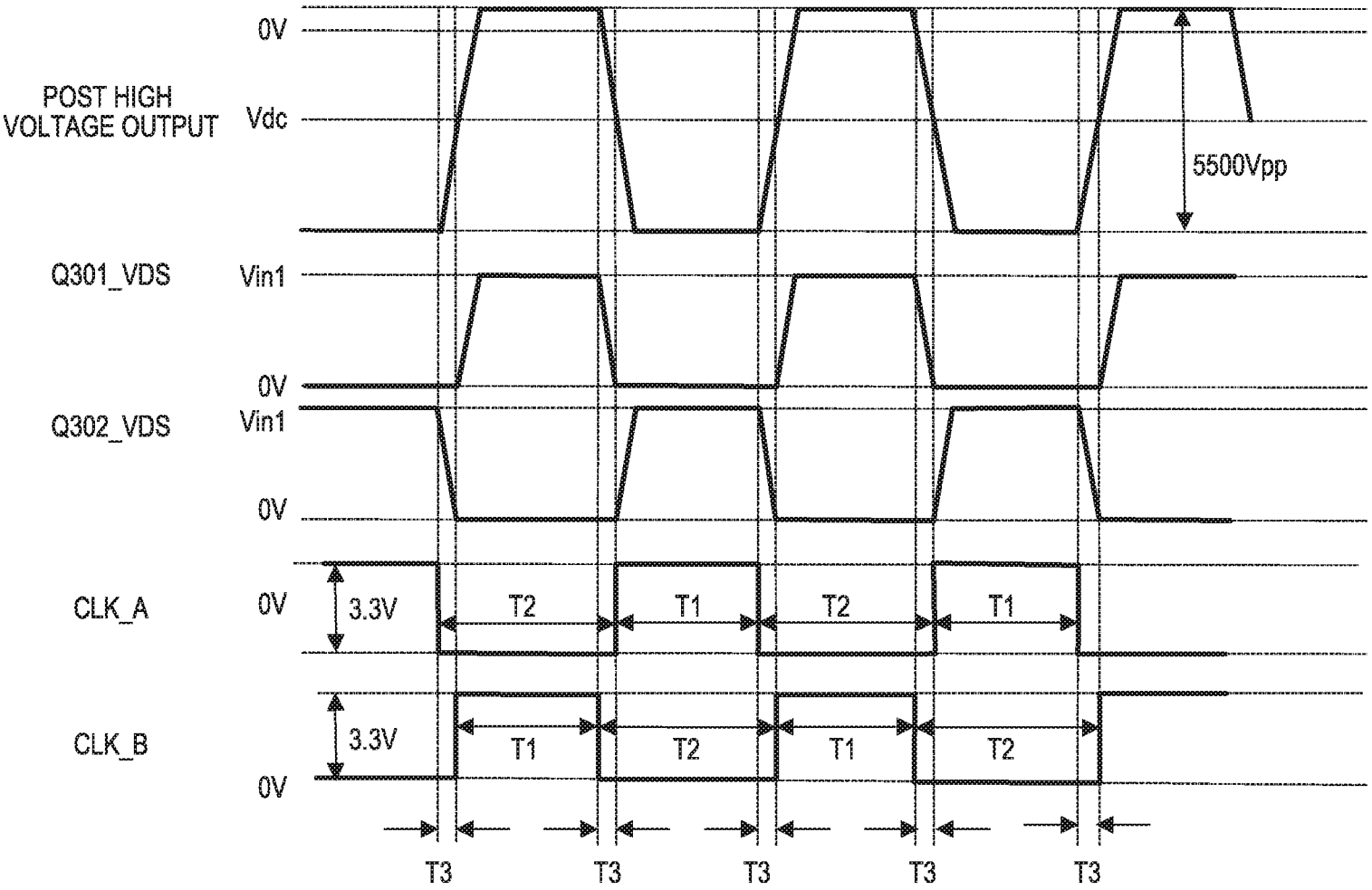

FIG. 3 shows the details of the AC power supply circuit 211. FIG. 4 shows various waveforms. Note that VDS indicates the voltage between a drain and a source of each FET. The AC power supply circuit 211 includes a transformer driving circuit 301, a DC/DC converter 302, a voltage detection circuit 303, and an AC transformer T301. The transformer driving circuit 301 is a circuit for driving the AC transformer T301, and includes damping resistors R301 and R302, pull-down resistors R303 and R304, an FET Q301, an FET Q302, and a capacitor C301. The FET Q301 executes a switching operation according to the driving signal CLK_A that is input through the damping resistor R301. The FET Q302 executes a switching operation according to the driving signal CLK_B that is input through the damping resistor R302. As shown in FIG. 4, the FET Q301 is turned on when the driving signal CLK_A is at a high level (3.3 V). The FET Q302 is turned on when the driving signal CLK_B is at a high level (3.3 V). The length of an ON period in which the driving signal CLK_A is at a high level is T1. The length of an ON period in which the driving signal CLK_B is at a high level is also T1. The length of an OFF period in which the driving signal CLK_A is at a low level is T2. The length of an OFF period in which the driving signal CLK_B is at a low level is also T2. The driving signal CLK_A and the driving signal CLK_B are basically signals of opposite phases, and therefore the FET Q301 and the FET Q302 are alternatingly turned on and off. If the FET Q301 and the FET Q302 are both in an ON state, a through current flows and the FET Q301 and the FET Q302 may be damaged. Therefore, a dead time T3 is provided in which both the driving signals CLK_A and CLK_B are at a low level.

The DC/DC converter 302 is a circuit that controls the voltage input to the AC transformer T301 to be a predetermined value Vin1 such that the charging AC voltage Vac, which is an AC component of the charging voltage Vout, is a predetermined value. The voltage detection circuit 303 is a circuit that detects the charging AC voltage Vac, and includes a diode D301 and a capacitor C302. In an auxiliary winding of the AC transformer T301, a voltage proportional to a secondary voltage that is generated in the secondary winding of the AC transformer T301 is generated. Then, the voltage generated in the auxiliary winding of the AC transformer T301 is detected by the voltage detection circuit 303, and is fed back to the DC/DC converter 302. When the charging AC voltage Vac is a predetermined value (e.g., 5500 Vpp), a voltage equal to a reference voltage Vcnt_ac is input to the DC/DC converter 302 from the voltage detection circuit 303. That is, the DC/DC converter 302 executes constant voltage control such that that voltage input from the voltage detection circuit 303 is equal to the reference voltage Vcnt_ac. The AC transformer T301 converts AC driving pulses generated by the transformer driving circuit 301 to an AC high voltage, and supplies the AC high voltage to the post charger 21. When voltages Q301_VDS and Q302_VDS are applied to a primary side of the AC transformer T301, an AC voltage of about 5500 Vpp is generated on a secondary side of the AC transformer T301, as shown in FIG. 4.

The AC detection circuit 212 is a circuit that detects an AC component of the charging voltage Vout by converting an AC component of the charging voltage Vout that is input through a capacitor C303 to a DC voltage signal. The voltage signal output from the AC detection circuit 212 is input to a terminal a of the first generation circuit 213.

Figure 5:
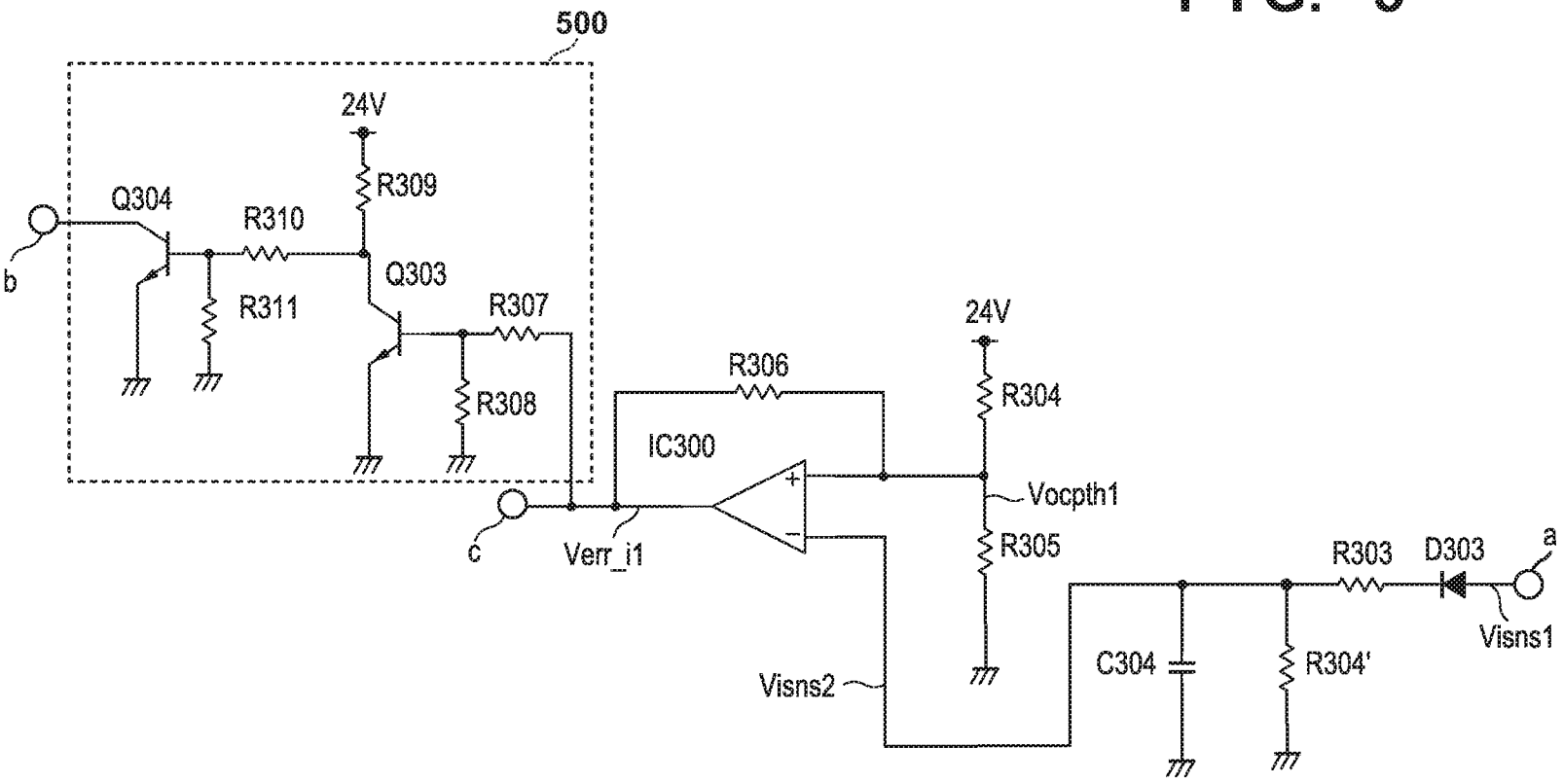
FIG. 5 is a diagram illustrating a first generation circuit.

The first generation circuit 213 shown in FIG. 5 has a function of protecting the power supply apparatus 26 from an overcurrent, in addition to a function of generating the first signal SG1. A comparator IC300 is a circuit that compares a voltage input to a plus input terminal and a voltage input to a minus input terminal, and outputs a comparison result. According to FIG. 5, a detection signal Visns1 input from the AC detection circuit 212 is input to a voltage-dividing circuit through a diode D303. The detection signal Visns1 passes through the diode D303, and therefore the voltage thereof decreases by a predetermined forward voltage (e.g., 0.6V). The voltage-dividing circuit is constituted by resistors R303 and R304'. With this, the detection signal Visns1 is converted to a detection signal Visns2. A threshold voltage Vocpth1 is input to the plus input terminal for overcurrent protection. The resistors R304 and R305 form a voltage-dividing circuit, which generates the threshold voltage Vocpth1 from a power supply voltage (e.g., 24V), here. A resistor R306 is connected between an output terminal and the plus input terminal of the comparator IC300.

Figure 6A:
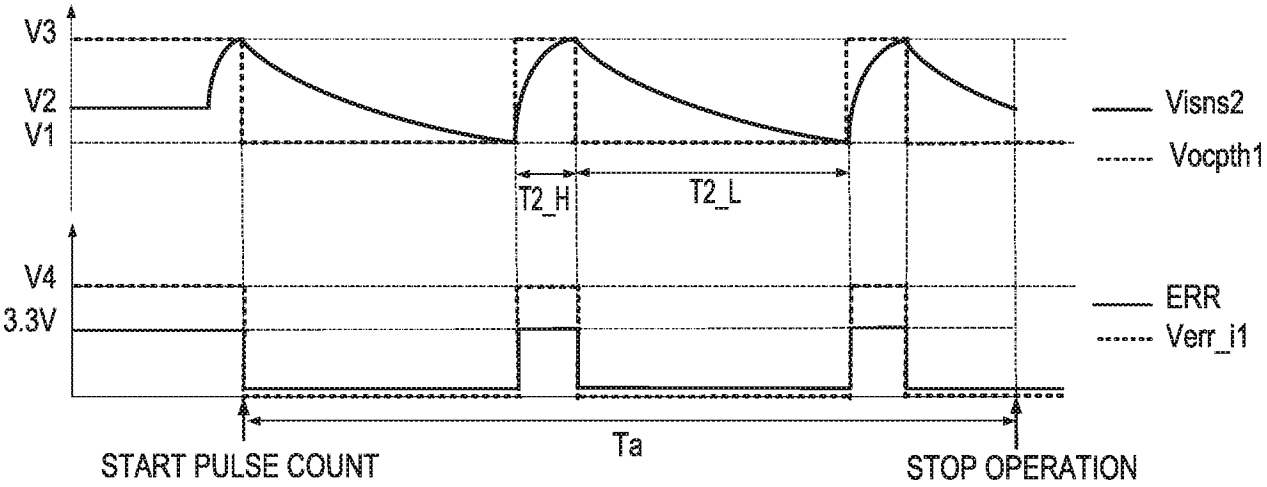
Figure 6B:
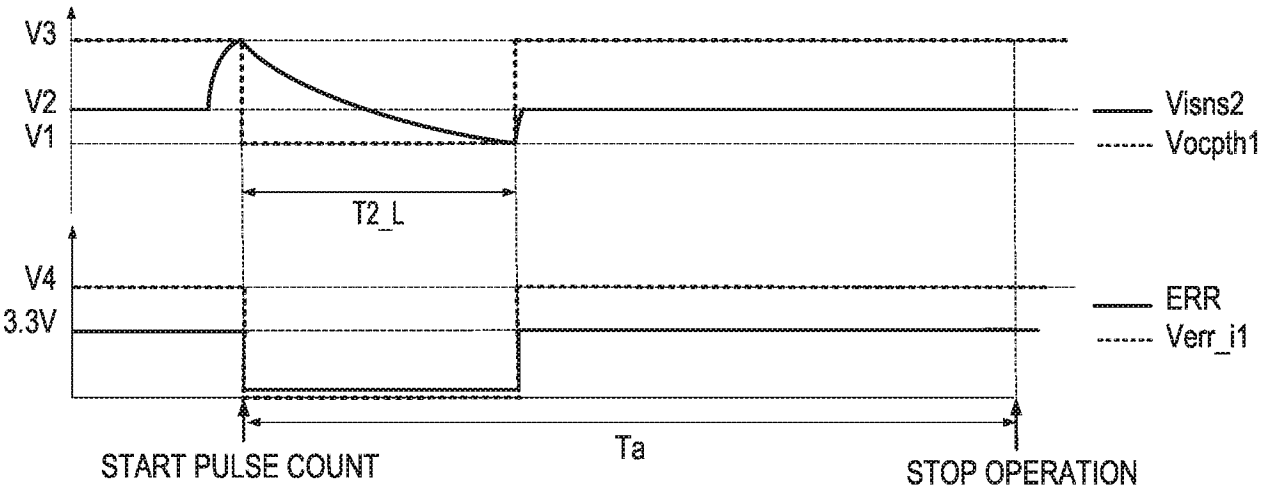

FIGS. 6A and 6B illustrate a relationship between the detection signal Visns2 and the threshold voltage Vocpth1 and a relationship between the error signal ERR and a voltage Verr_i1. The voltage Verr_i1 is a voltage corresponding to the comparison result of the comparator IC300. A voltage V2 corresponds to the detection signal Visns2 when a charging current at a normal level is flowing in the post charger 21. The threshold voltage Vocpth1 is a voltage V3. Because the voltage V2 is lower than the voltage V3, the output terminal of the comparator IC300 is configured as an open collector. Therefore, the voltage Verr_i1 of the output terminal of the comparator IC300 is a voltage V4. The voltage V4 is set to a voltage larger than 3.3 V. Therefore, when the voltage Verr_i1 is at the voltage V4, the signal level of the error signal ERR is 3.3 V (high level).

The CPU 200 monitors the logic level of the error signal ERR. When the error signal ERR continues to be at a high level during an image forming operation, the CPU 200 determines that the charging AC voltage Vac is properly output.

In FIG. 5, transistors Q303 and Q304 and resistors R307, R308, R309, R310, and R311 form an overcurrent protection circuit 500. The overcurrent protection circuit 500 is a circuit that, if an overcurrent is detected, causes the transformer driving circuit 301 to stop switching operation. When the voltage Verr_i1 is at the voltage V4, the transistor Q303 is turned on and the transistor Q304 is turned off Therefore, the driving signals CLK_A and CLK_B are respectively supplied to the FETs Q301 and Q302 of the transformer driving circuit 301. In this case, the FETs Q301 and Q302 execute a switching operation, and as a result, the charging voltage Vout is generated.

As shown in FIG. 6A, if an overcurrent occurs, the detection signal Visns2 reaches the threshold voltage Vocpth1 (=V3). Here, the voltage of the minus input terminal of the comparator IC300 is lower than the voltage of the plus input terminal thereof. If the detection signal Visns2 exceeds the threshold voltage Vocpth1 (=V3), the output terminal of the comparator IC300 enters a short-circuit state. Therefore, the voltage Verr_i1 at the output terminal is 0 V. With this, the threshold voltage Vocpth1 is switched from the voltage V3 for overcurrent protection to the voltage V1 for canceling protection. The voltage V1 is a voltage set by a power supply voltage of 24 V and a voltage-dividing circuit formed by the resistors R304, R305, and R306. When the voltage Verr_i1 is 0 V, the error signal ERR is at a voltage (low level) obtained by subtracting a forward voltage (e.g., about 0.6 V) of the diode D302 from the voltage Verr_i1.

The CPU 200 monitors the logic level of the error signal ERR. When the level of the error signal ERR changes from a high level to a low level during an image forming operation, the CPU 200 executes state determination processing.

When the voltage Verr_i1 is 0 V, in the overcurrent protection circuit 500 shown in FIG. 5, the transistor Q303 is turned off and the transistor Q304 is turned on. With this, in the transformer driving circuit 301, the driving signal CLK_A supplied to the FET Q301 and the driving signal CLK_B supplied to the FET Q302 are both cut off. Therefore, the AC power supply circuit 211 stops outputting the charging AC voltage Vac. Note that, because the output of a terminal b of the first generation circuit 213 is also connected to a terminal e of the second generation circuit 223, when the transistor Q304 is turned on, the driving signal CLK_C is also cut off. As a result, when the output of the AC power supply circuit 211 is stopped in the overcurrent protection operation, the output of the DC power supply circuit 221 is also stopped.

When the output of the charging AC voltage Vac is stopped, a current no longer flows through the wire 28. Therefore, the voltage of the detection signal Visns2 changes to a voltage lower than the voltage V3. The reduction of the detection signal Visns2 is realized by discharging charges accumulated in a capacitor C304 through the resistor R304'. A time T2_L needed for the voltage of the detection signal Visns2 to decrease from the voltage V3 to the voltage V1 is determined by the capacitance of the capacitor C304 and the resistance value of the resistor R304'. That is, the capacitor C304 and the resistor R304' form a time constant circuit. The time T2_L depends on a time constant of this time constant circuit.

When the voltage of the detection signal Visns2 decreases to the voltage V1 or lower, the output terminal of the comparator IC300 enters an open-circuit state. Therefore, the voltage Verr_i1 of the output terminal becomes the voltage V4, and the threshold voltage Vocpth1 returns from the voltage V1 to the voltage V3. When the voltage Verr_i1 becomes the voltage V4, the transistor Q303 is turned on and the transistor Q304 is turned off Therefore, the driving signals CLK_A and CLK_B are again supplied to the FETs Q301 and Q302 of the transformer driving circuit 301, and the FETs Q301 and Q302 start the switching operation again. With this, the AC power supply circuit 211 again starts outputting the charging AC voltage Vac. If the post charger 21 is in a leakage state when outputting of the charging AC voltage Vac is again started, the detection signal Visns2 again increases to the voltage V3, and therefore outputting of the charging AC voltage Vac is again stopped. Note that the time needed for the voltage of the detection signal Visns2 to increase from the voltage V1 to the voltage V3 is a time T2_H, as shown in FIG. 6A. The time T2_H is a time needed to charge the capacitor C304 through the resistor R303. That is, the time T2_H depends on a time constant of a time constant circuit constituted by the resistor R303 and the capacitor C304. The time T2_H is determined by the capacitance of the capacitor C304 and the resistance value of the resistor R303. As described above, while the post charger 21 continues to be in a leakage state, the AC power supply circuit 211 intermittently operates in a period that is a sum of the time T2_H and the time T2_L. This operation may also be called as an intermittent protection operation.

FIG. 6B shows a case where a leakage current disappears when the time T2_L has elapsed from when outputting of the charging AC voltage Vac is stopped due to an occurrence of a leakage current. A leakage current occurs when a paper scrap or the like has attached to the wire 28. Therefore, when a paper scrap or the like is removed, the leakage current disappears. When the leakage current disappears, and the operation of the AC power supply circuit 211 is started again, the voltage of the detection signal Visns2 becomes the voltage V2.

DC Power Supply Circuit

Figure 7:
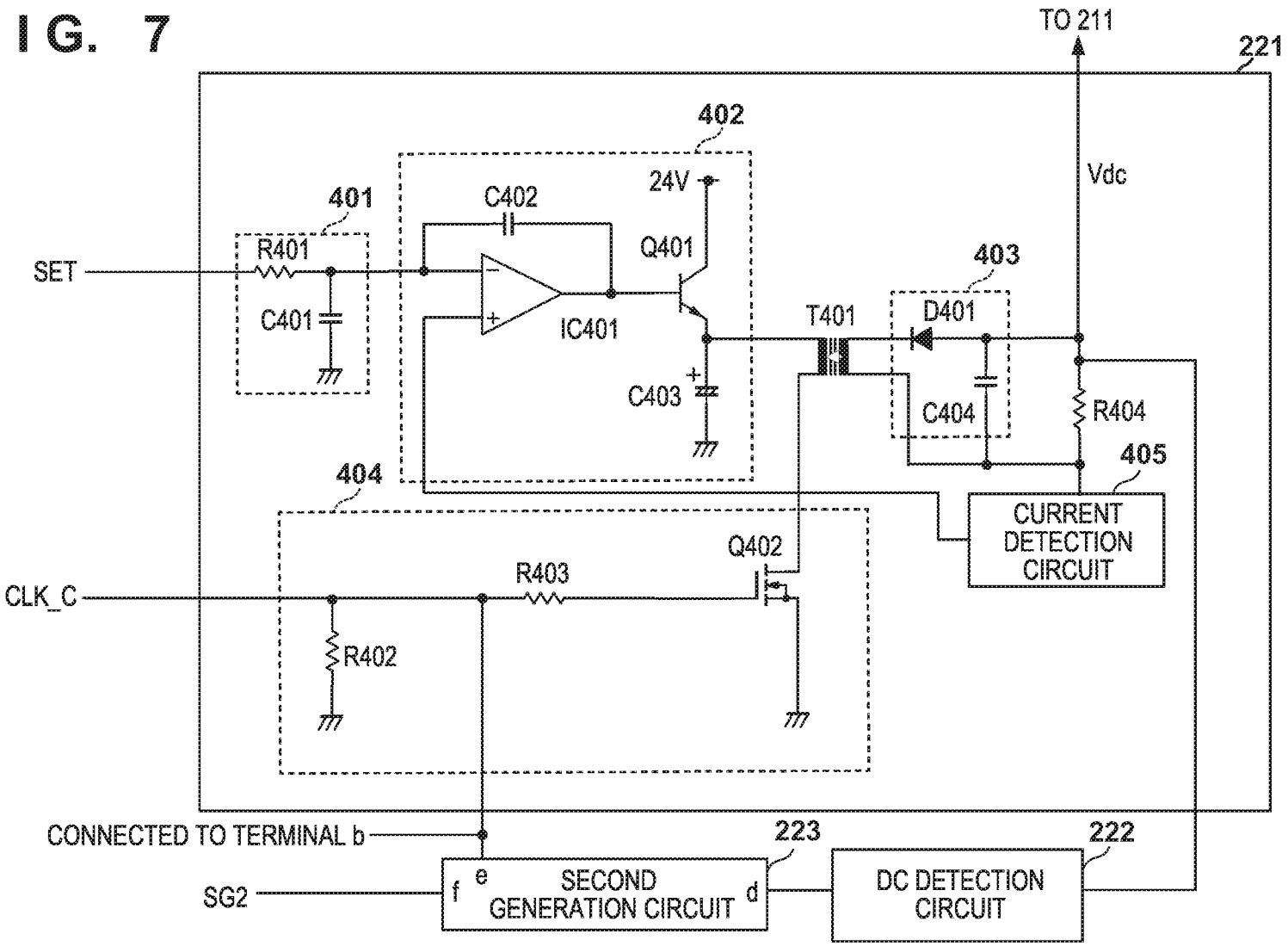
FIG. 7 is a diagram illustrating a DC power supply circuit.

As shown in FIG. 7, the DC power supply circuit 221 includes a smoothing circuit 401, a constant current control circuit 402, a rectifier circuit 403, a transformer driving circuit 404, and a current detection circuit 405. The DC power supply circuit 221 generates and outputs the charging DC voltage Vdc, which is a DC component of the charging voltage Vout, by being supplied with the driving signal CLK_C from the CPU 200.

The smoothing circuit 401 is a low pass filter constituted by a resistor R401 and a capacitor C401, and converts a PWM signal (DC setting signal) input from the CPU 200 to a DC voltage with a predetermined cut-off frequency. The CPU 200 can change the charging DC voltage Vdc by changing the duty ratio of the PWM signal. When the duty ratio is 88% (3.0 V), the current based on the charging DC voltage Vdc is 0 [μA]. When the duty ratio is 0% (0 V), the current based on the charging DC voltage Vdc is −350 [μA].

The constant current control circuit 402 is constituted by an operational amplifier IC401, a capacitor C402, a transistor Q401, and an electrolytic capacitor C403. A DC voltage output from the smoothing circuit 401 is input to a minus input terminal of the operational amplifier IC401. A detection result output from the current detection circuit 405 is fed back to a plus input terminal. The operational amplifier IC401 is an inverting amplifier circuit that adjusts the output voltage such that the voltage of the plus input terminal matches the voltage of the minus input terminal. The capacitor C402 is a capacitor for stabilizing the output voltage of the amplifier circuit. The output terminal of the operational amplifier IC401 is connected to a base of the common-collector transistor Q401. The emitter voltage of the transistor Q401 is lower than the voltage of the output terminal of the operational amplifier IC401 by a base-emitter voltage (about 0.6 V) of the transistor Q401. The electrolytic capacitor C403 for stabilizing the voltage is connected to the emitter of the transistor Q401.

The transformer driving circuit 404 is a circuit that drives a DC transformer T401. The DC transformer T401 is a transformer for stepping up the emitter voltage of the transistor Q401. The transformer driving circuit 404 is constituted by a pull-down resistor R402, a damping resistor R403, and an FET Q402. The FET Q402 is repeatedly turned on and off according to the driving signal CLK_C. For example, the frequency and the duty ratio of the driving signal CLK_C may respectively be 50 kHz and 25%. With this, starting and stopping of the operation of the DC transformer T401 is controlled.

The rectifier circuit 403 is constituted by a diode D401 and a capacitor C404. The rectifier circuit 403 outputs a negative DC current (e.g., 0 [μA] to −350 [μA]) by rectifying and smoothing the AC voltage output from the DC transformer T401. A resistor R404 is a resistor for discharging charges accumulated in the capacitor C404.

The DC detection circuit 222 is a circuit that converts the charging DC voltage Vdc to a detection signal Vvsns1. The DC detection circuit 222 is a voltage conversion circuit such as a voltage-dividing circuit. The detection signal Vvsns1 generated by the DC detection circuit 222 is input to a terminal d of the second generation circuit 223.

Figure 8:
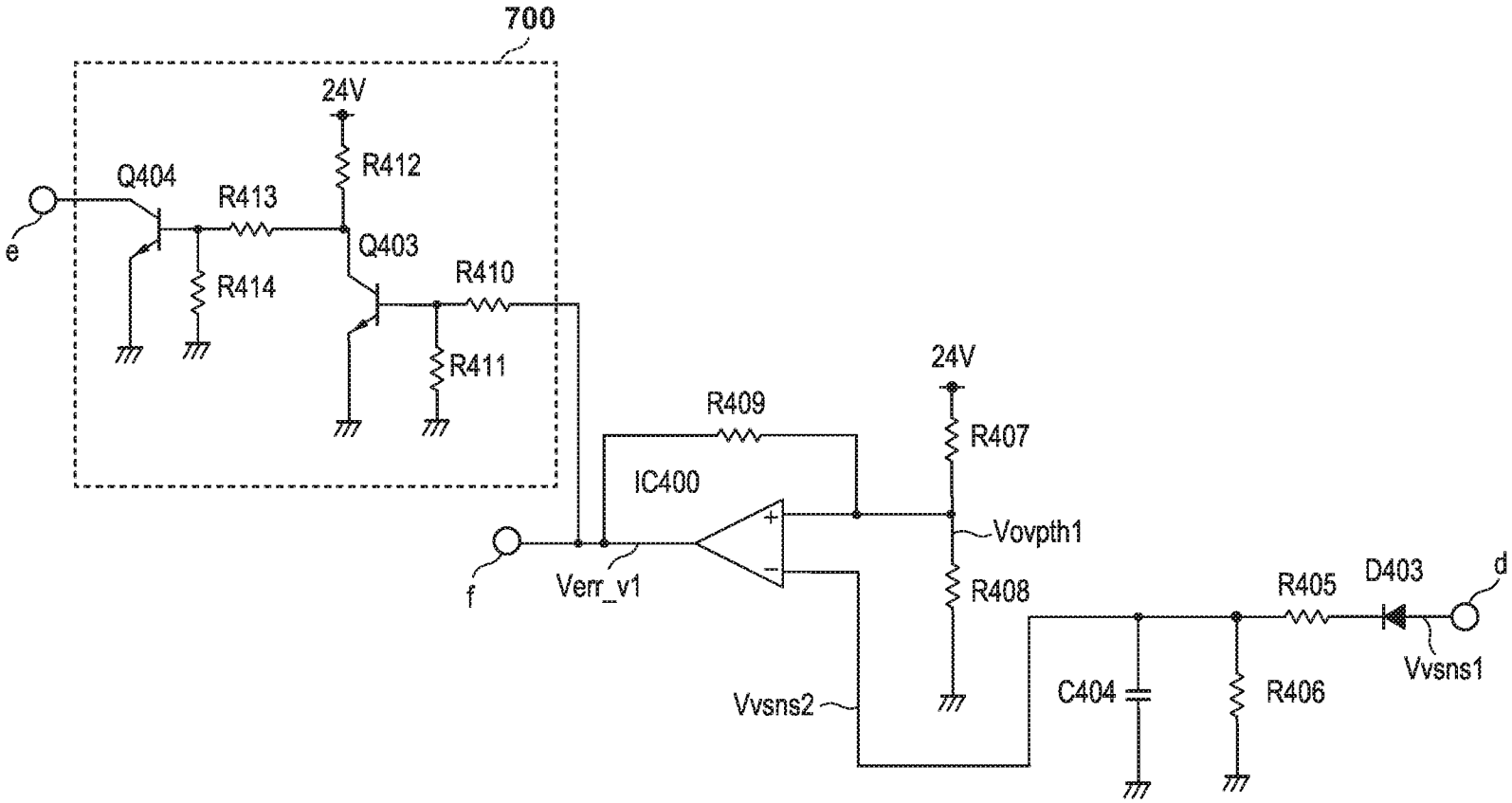
FIG. 8 is a diagram illustrating a second generation circuit.
Figure 9A:
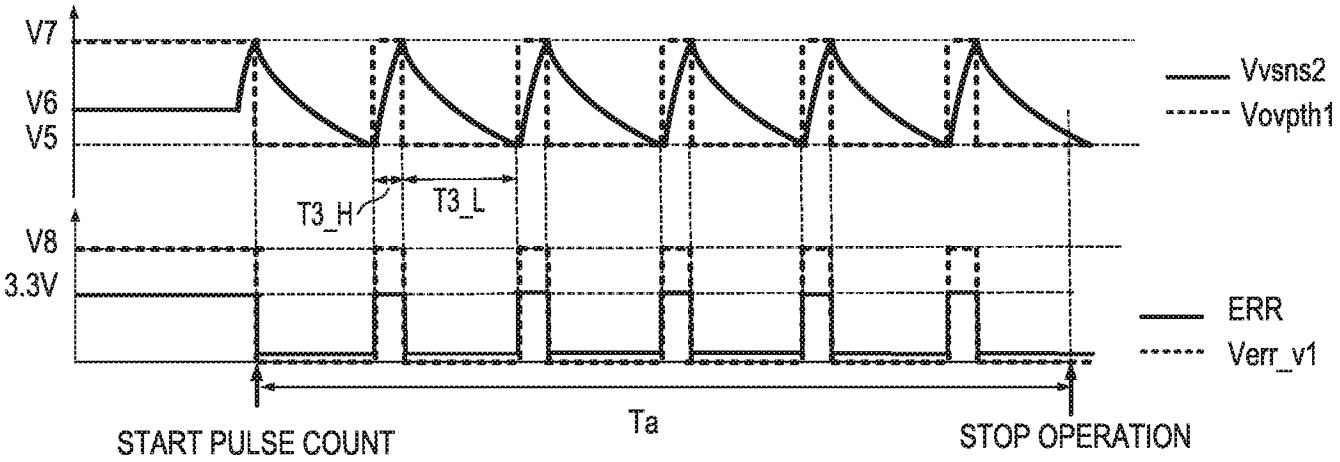

FIG. 8 is a circuit diagram of the second generation circuit 223. FIG. 9A illustrates the relationship between a detection signal Vvsns2 and a threshold voltage Vovpth1 and the relationship between the error signal ERR and a voltage Verr_v1. The detection signal Vvsns2 is input to a minus input terminal of a comparator IC400. The detection signal Vvsns1 is converted to a detection signal Vvsns2 by a voltage conversion circuit constituted by a diode D403 and resistors R405 and R406. The threshold voltage Vovpth1 for overvoltage protection is input to a plus input terminal of the comparator IC400. The threshold voltage Vovpth1 (Vovpth1=V7) is generated by voltage-dividing 24 V by a voltage-dividing circuit constituted by a resistor R407 and a resistor R408, for example. Alternatively, the threshold voltage Vovpth1 (Vovpth1=V5) is generated by voltage-dividing 24 V by a voltage-dividing circuit constituted by the resistor R407, the resistor R408, and a resistor R409, for example. In FIG. 9A, a voltage V6 is a voltage of the detection signal Vvsns2 when a normal charging voltage Vout is applied to the post charger 21. In this case, because the detection signal Vvsns2 is lower than the threshold voltage Vovpth1 (=V7), the output terminal of the comparator IC400 is configured as an open collector. Therefore, the voltage Verr_v1 of the output terminal is a voltage V8. The voltage V8 is set to be larger than 3.3 V. Therefore, when the voltage Verr_v1 is the voltage V8, the signal level of the error signal ERR is 3.3 V (high level). The CPU 200 determines that the charging voltage Vout is normal when the error signal ERR is at a high level during image forming operation.

An overvoltage protection circuit 700 shown in FIG. 8 is constituted by transistors Q403 and Q404 and resistors R410, R411, R412, R413, and R414. If the wire 28 is broken and an overvoltage is generated, the overvoltage protection circuit 700 causes the transformer driving circuit 404 to stop the switching operation. With this, the DC power supply circuit 221 is protected from an overvoltage.

If an overvoltage does not occur, the voltage Verr_v1 is the voltage V6. Therefore, the transistor Q403 is turned on and the transistor Q404 is turned off. As a result, the driving signal CLK_C is supplied to the FET Q402 of the transformer driving circuit 404. As a result of the FET Q402 of the transformer driving circuit 404 executing the switching operation, the DC power supply circuit 221 generates the charging DC voltage Vdc.

In FIG. 9A, a voltage V7 is a voltage set as the threshold voltage Vovpth1 for overvoltage protection. If the detection signal Vvsns2 exceeds the threshold voltage Vovpth1 (=V7), the output terminal of the comparator IC400 enters a short-circuit state. Therefore, the voltage Verr_v1 of the output terminal becomes 0 V. With this, the threshold value Vovpth1 switches from the voltage V7 to a voltage V5 for canceling protection. When the voltage Verr_v1 is 0 V, the error signal ERR is at a low level. Upon detecting the error signal ERR changing from a high level to a low level, the CPU 200 executes the state determination processing.

When the voltage Verr_v1 is 0 V, the transistor Q403 of the overvoltage protection circuit 700 is turned off, and the transistor Q404 is turned on. As a result, the driving signal CLK_C that has been supplied to the FET Q402 of the transformer driving circuit 404 is cut off. As a result, the transistor Q402 stops the switching operation, and therefore the DC power supply circuit 221 stops operation. Note that the output of the terminal e of the second generation circuit 223 is also input to the terminal b of the first generation circuit, and therefore, when the transistor Q404 is turned on, the driving signals CLK_A and CLK_B are also cut off. As a result, when the DC power supply circuit 221 stops operation due to overvoltage protection operation, the AC power supply circuit 211 also stops operation. When the output of the charging DC voltage Vdc stops, the detection signal Vvsns2 decreases from the voltage V7. As a result of discharging charges accumulated in a capacitor C404 through the resistor R404, the detection signal Vvsns2 decreases. A time T3_L needed for the detection signal Vvsns2 to decrease from the voltage V7 to the voltage V5 depends on the time constant of a time constant circuit constituted by the capacitor C404 and the resistor R404. That is, the time T3_L is determined based on the capacitance of the capacitor C404 and the resistance value of the resistor R404.

When the detection signal Vvsns2 decreases to the voltage V5 or below, the output terminal of the comparator IC400 enters an open-circuit state. As illustrated in FIG. 9A, because the voltage Verr_v1 becomes the voltage V8, the threshold voltage Vovpth1 switches from the voltage V5 to the voltage V7. When the voltage Verr_v1 becomes the voltage V8, the transistor Q403 is turned on and the transistor Q404 is turned off. As a result, the supply of the driving signal CLK_C to the FET Q402 is re-started, and therefore the FET Q402 re-starts the switching operation. Therefore, the DC power supply circuit 221 re-starts generation of the DC component.

If the wire 28 of the post charger 21 is broken, when the generation of the charging DC voltage Vdc is re-started, the detection signal Vvsns2 again increases to the voltage V7, and therefore the DC power supply circuit 221 stops generating the DC component. As a result of the capacitor C404 being charged through the resistor R405, the detection signal Vvsns2 increases from the voltage V5 to the voltage V7. Therefore, a time T3_H needed for the detection signal Vvsns2 to increase from the voltage V5 to the voltage V7 is determined by the capacitance of the capacitor C404 and the resistance value of the resistor R405. The time T3_H depends on the time constant of a time constant circuit constituted by the capacitor C404 and the resistor R405. The second generation circuit 223 intermittently executes the overvoltage protection operation in a period obtained by adding the time T3_L to the time T3_H.

Flowchart

Figure 10:
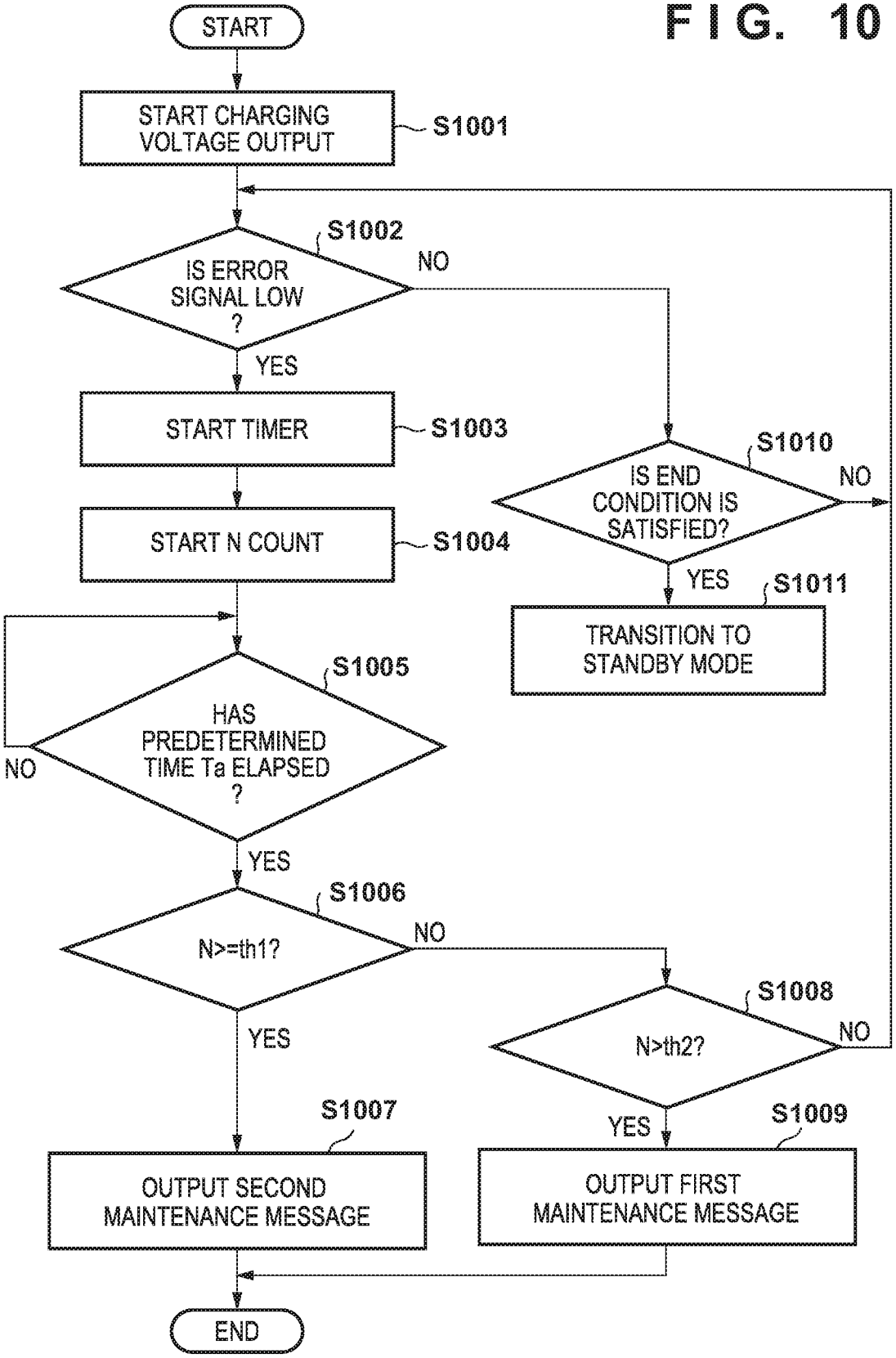
FIG. 10 is a flowchart illustrating signal identification processing.

FIG. 10 is a flowchart illustrating signal identification processing that is executed by the CPU 200 in accordance with a control program. Upon being instructed by a user to execute image formation, the CPU 200 executes the following processing.

In step S1001, the CPU 200 starts outputting the charging voltage Vout by controlling the power supply apparatus 26. For example, the CPU 200 starts outputting the driving signals CLK_A, CLK_B, and CLK_C. The power supply apparatus 26 generates the charging voltage Vout according to the driving signals CLK_A, CLK_B, and CLK_C, and applies the charging voltage Vout to the wire 28. The CPU 200 starts monitoring the error signal ERR.

In step S1002, the CPU 200 (identification section 203) determines whether the logic of the error signal ERR is Low. The logic of the error signal ERR is normally High. As described above, if leakage occurs in the wire 28, the first signal SG1 is output, and therefore the logic of the error signal ERR becomes Low. Similarly, if the wire 28 is broken, the second signal SG2 is output, and therefore the logic of the error signal ERR becomes Low. On the other hand, if the logic of the error signal ERR is not Low, the CPU 200 advances the processing to step S1010. In step S1010, the CPU 200 determines whether an end condition is satisfied. The end condition refers to a condition that the image formation instructed by the user has ended. Upon the image formation having ended, the CPU 200 advances the processing to step S1011. In step S1011, the CPU 200 causes the image forming apparatus 100 to transition to a standby mode. On the other hand, in step S1010, if the end condition is not satisfied, the CPU 200 advances the processing to step S1002. If the logic of the error signal ERR is Low in step S1002, the CPU 200 advances the processing to step S1003.

In step S1003, the CPU 200 starts the timer 201. In step S1004, the CPU 200 (counter 202) starts counting the number of pulses N included in the error signal ERR. For example, the counter 202 adds one to the count value every time a rising or falling edge of a pulse is detected.

In step S1005, the CPU 200 determines whether or not a predetermined time Ta has elapsed since the timer 201 has started measuring time. That is, the CPU 200 determines whether or not the time measured by the timer 201 has reached the predetermined time Ta. The CPU 200 determines whether or not the predetermined time Ta has elapsed. If the predetermined time Ta has not elapsed, the counter 202 continues counting the pulses. If the predetermined time Ta has elapsed, the CPU 200 advances the processing to step S1006.

In steps S1006 and S1008, the CPU 200 determines which of the first signal SG1 and the second signal SG2 has been output as the error signal ERR based on the count value N (number of pulses). This determination processing is processing for determining which of a first maintenance (e.g., cleaning of the wire 28) or a second maintenance (e.g., repair or replacement of the post charger 21) is needed. That is, the determination processing corresponds to processing for determining which of leakage and breakage occurs regarding the wire 28.

In step S1006, the CPU 200 (identification section 203) determines whether or not the count value N is a threshold value th1 or more. According to the example in FIG. 6A, when leakage occurs, two pulses are output during a predetermined time Ta. According to the example in FIG. 9A, when breakage occurs, five pulses are output during the predetermined time Ta. In this case, as a result of setting 3 to the threshold value th1, identification between leakage (first signal SG1) and breakage (second signal SG2) is possible. If the count value N is the threshold value th1 or more, the CPU 200 advances the processing to step S1007. If the count value N is less than the threshold value th1, the CPU 200 advances the processing to step S1008.

In step S1007, the CPU 200 (notification section 204) outputs a second maintenance message to the display apparatus 27. The second maintenance message may include maintenance information indicating that repair or replacement of the post charger 21 is needed. The second maintenance message may include state information indicating that the wire 28 has been broken (post charger 21 has failed). The second maintenance message may be an error code or the like. Thereafter, the CPU 200 stops outputting the driving signals CLK_A, CLK_B, and CLK_C, and causes the image forming apparatus 100 to stop image forming operation.

In step S1008, the CPU 200 (identification section 203) determines whether or not the count value N exceeds a threshold value th2. Here, the threshold value th2 is smaller than the threshold value th1. According to the example in FIG. 6A, 1 is set to the threshold value th2. That is, if the count value N is 2, it can be understood that leakage occurs. According to the example in FIG. 6B, if the count value N is 1, the leakage has disappeared after leakage occurred. If the count value N exceeds the threshold value th2, the CPU 200 advances the processing to step S1009. If the count value N does not exceed the threshold value th2, the CPU 200 advances the processing to step S1002.

In step S1009, the CPU 200 (notification section 204) outputs a first maintenance message to the display apparatus 27. The first maintenance message may include maintenance information indicating that the wire 28 needs to be cleaned. The first maintenance message may include state information indicating that a contaminant is attached to the wire 28. The first maintenance message may be an error code or the like. Thereafter, the CPU 200 stops outputting the driving signals CLK_A, CLK_B, and CLK_C, and stops the image forming operation of the image forming apparatus 100.

Embodiment 2

Figure 9B:
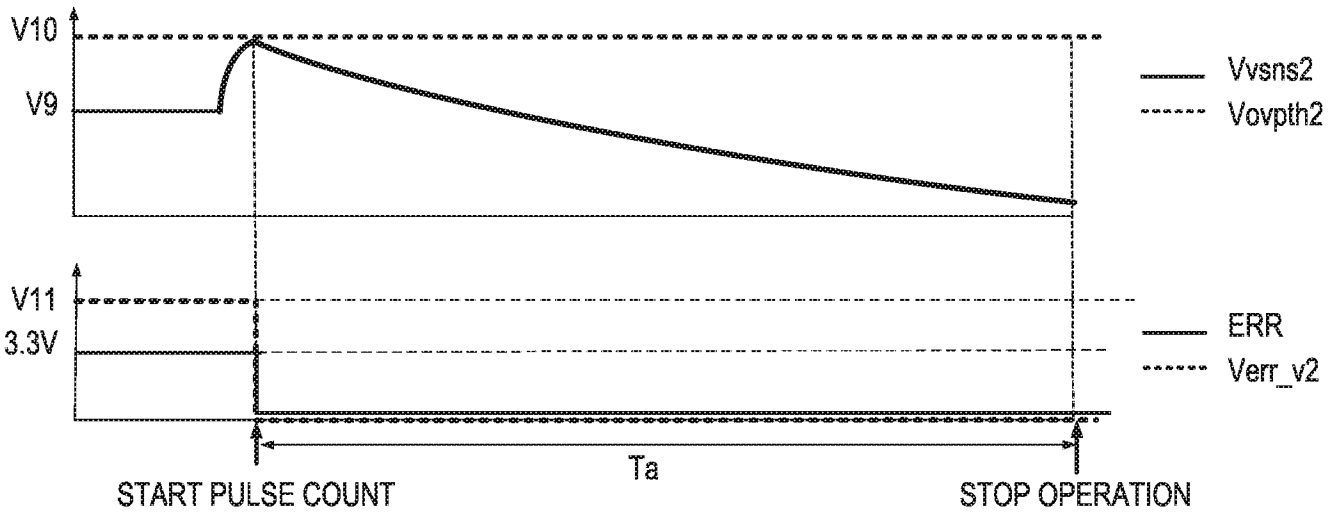
Figure 11:
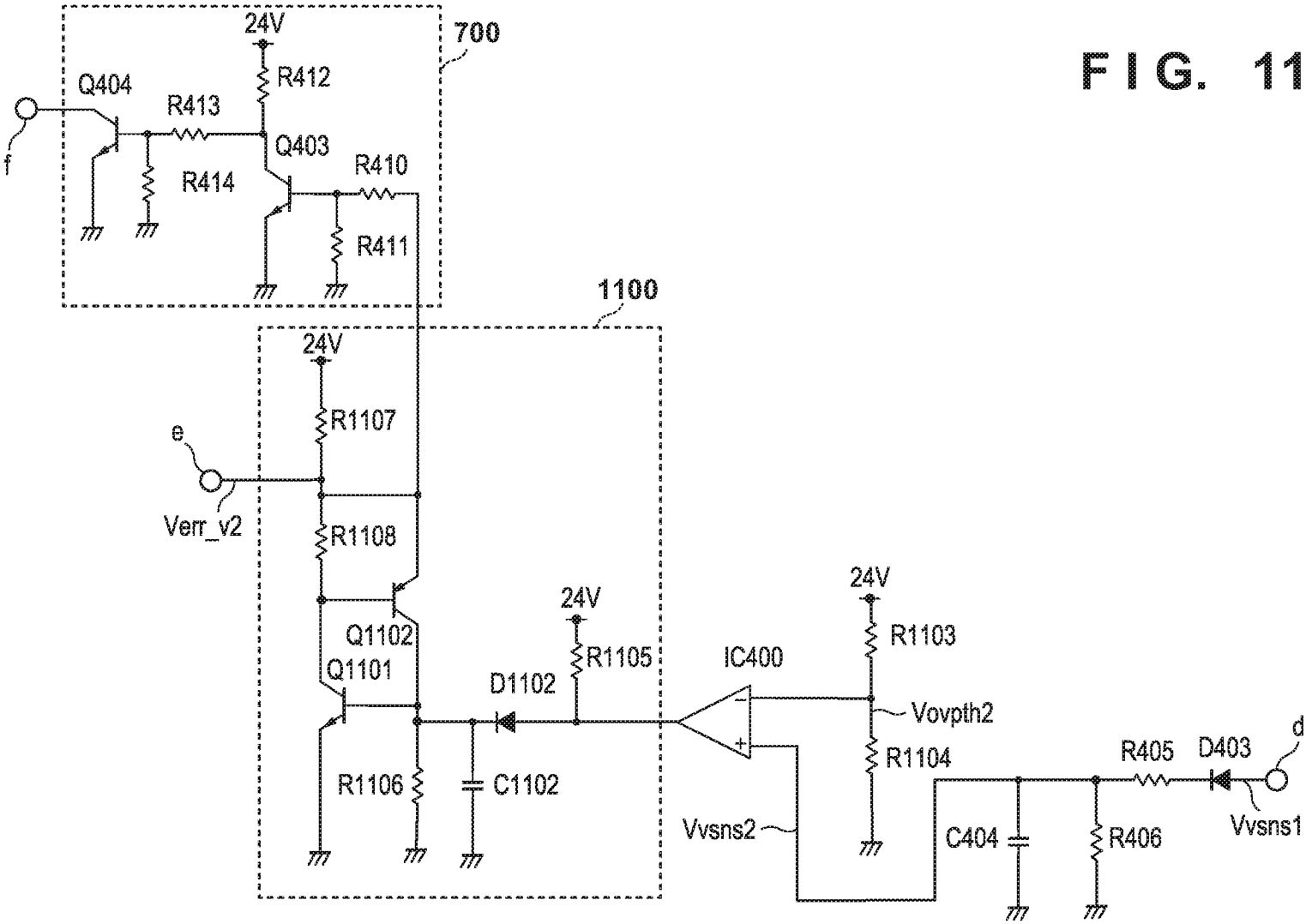
FIG. 11 is a diagram illustrating the second generation circuit.

FIG. 11 shows the second generation circuit 223 in Embodiment 2. FIG. 9B shows the relationship between the detection signal Vvsns2 and a threshold voltage Vovpth2, and the relationship between the error signal ERR and a voltage Verr_v2. The constituent elements that have already been described in Embodiment 1 are given the same reference signs. Compared with Embodiment 1, in Embodiment 2, the threshold voltage Vovpth2 of the comparator IC400 is set by resistors R1103 and R1104 and the voltage of the 24V power supply. Because the resistor R409 is not present, the threshold voltage Vovpth2 is a fixed value. Moreover, a latch circuit 1100 is provided on an output side of the comparator IC400. The latch circuit 1100 latches a comparison result that is output from the comparator IC400 and indicates that the wire 28 is broken. That is, if the wire 28 is broken, the voltage Verr_v2 indicating the comparison result of the comparator IC400 is latched at a low level. Also, since the voltage Verr_v2 is latched at a low level, the overvoltage protection circuit 700 keeps the overvoltage protection state. That is, the overvoltage protection circuit 700 cuts off the driving signal CLK_C.

When the wire 28 is broken, the post charger 21 cannot function as a charger. Also, a portion of the broken wire 28 may come into contact with a housing of the image forming apparatus 100 or another printed board. Also, the broken wire 28 cannot be restored, and needs to be replaced. Therefore, when an overvoltage is detected, the output of the charging voltage Vout is continuously stopped.

The latch circuit 1100 is constituted by transistors Q1101 and Q1102, resistors R1105, R1106, R1107, and R1108, a capacitor C1102, and a diode D1102.

In FIG. 9B, a voltage V9 is the voltage of the detection signal Vvsns2 when the charging voltage Vout at a proper level is applied to the post charger 21. In this case, the detection signal Vvsns2 (=V9) is applied to the plus input terminal of the comparator IC400. The threshold voltage Vovpth2 (=V10) is applied to the minus input terminal. As shown in FIG. 9B, because the voltage V9 is lower than the voltage V10, the output terminal of the comparator IC400 is in a short-circuit state. That is, the output terminal is at 0 V. The transistors Q1101 and Q1102 in the latch circuit 1100 are both turned off Therefore the voltage Verr_v2 at the output terminal e becomes a voltage V11. The voltage V11 is set by the resistor R1107 and the like so as to be larger than 3.3 V. When the voltage Verr_v2 is the voltage V11, the signal level of the error signal ERR (second signal SG2) is 3.3 V (high level). Upon recognizing that the logic level of the error signal ERR is a high level, the CPU 200 determines that the power supply apparatus 26 properly outputs the charging voltage Vout.

When the voltage Verr_v2 is the voltage V11, the overvoltage protection circuit 700 allows the supply of the driving signal CLK_C to the transformer driving circuit 404. With this, the transformer driving circuit 404 executes the switching operation, and the DC power supply circuit 221 outputs the DC component of the charging voltage Vout.

If the detection signal Vvsns2 exceeds the threshold voltage Vovpth2, the output terminal of the comparator IC400 enters an open-circuit state. Here, a base current flows from the 24V power supply to the transistor Q1101 via the resistor R1105 and the diode D1102. With this, the transistor Q1101 is turned on. When the transistor Q1101 is turned on, a base current flows in the transistor Q1102. Therefore, the transistor Q1102 is also turned on. When the transistor Q1102 is turned on, a base current is supplied from a collector of the transistor Q1102 to the transistor Q1101. Therefore, the transistor Q1101 is also kept in an on state. In this way, when the transistors Q1101 and Q1102 are both turned on, the voltage Verr_v2 becomes 0 V. When the voltage Verr_v2 is 0 V, the level of the error signal ERR equals to a forward voltage (about 0.6 V) of the diode D402, and therefore the error signal ERR is at a low level.

The CPU 200 monitors the logic level of the error signal ERR, and upon detecting that the signal level is a low level during an image forming operation, starts executing abnormal state determination processing, which will be described later.

When the voltage Verr_v2 is 0 V, the overvoltage protection circuit 700 cuts off the driving signal CLK_C. With this, the transformer driving circuit 404 stops the switching operation, and the DC power supply circuit 221 stops outputting the DC component of the charging voltage Vout.

Incidentally, when outputting of the charging voltage Vout is stopped, the voltage level of the detection signal Vvsns1 decreases, and therefore the voltage level of the detection signal Vvsns2 also decreases. The detection signal Vvsns2 decreases below the threshold voltage Vovpth2 (=V10). Therefore, the output terminal of the comparator IC400 enters a short-circuit state. Since the output terminal of the comparator IC400 is at 0 V, a base current does not flow in the transistor Q1101 from the 24V power supply through the resistor R1105. However, a base current of the transistor Q1101 is supplied from the collector of the transistor Q1102, and therefore the transistor Q1101 is kept in an on state. In this way, in Embodiment 2, once the output terminal of the comparator IC400 enters an open state, the error signal ERR is kept at a low level, and the overvoltage protection circuit 700 also keeps the overcurrent protection state.

Flowchart

Figure 12:
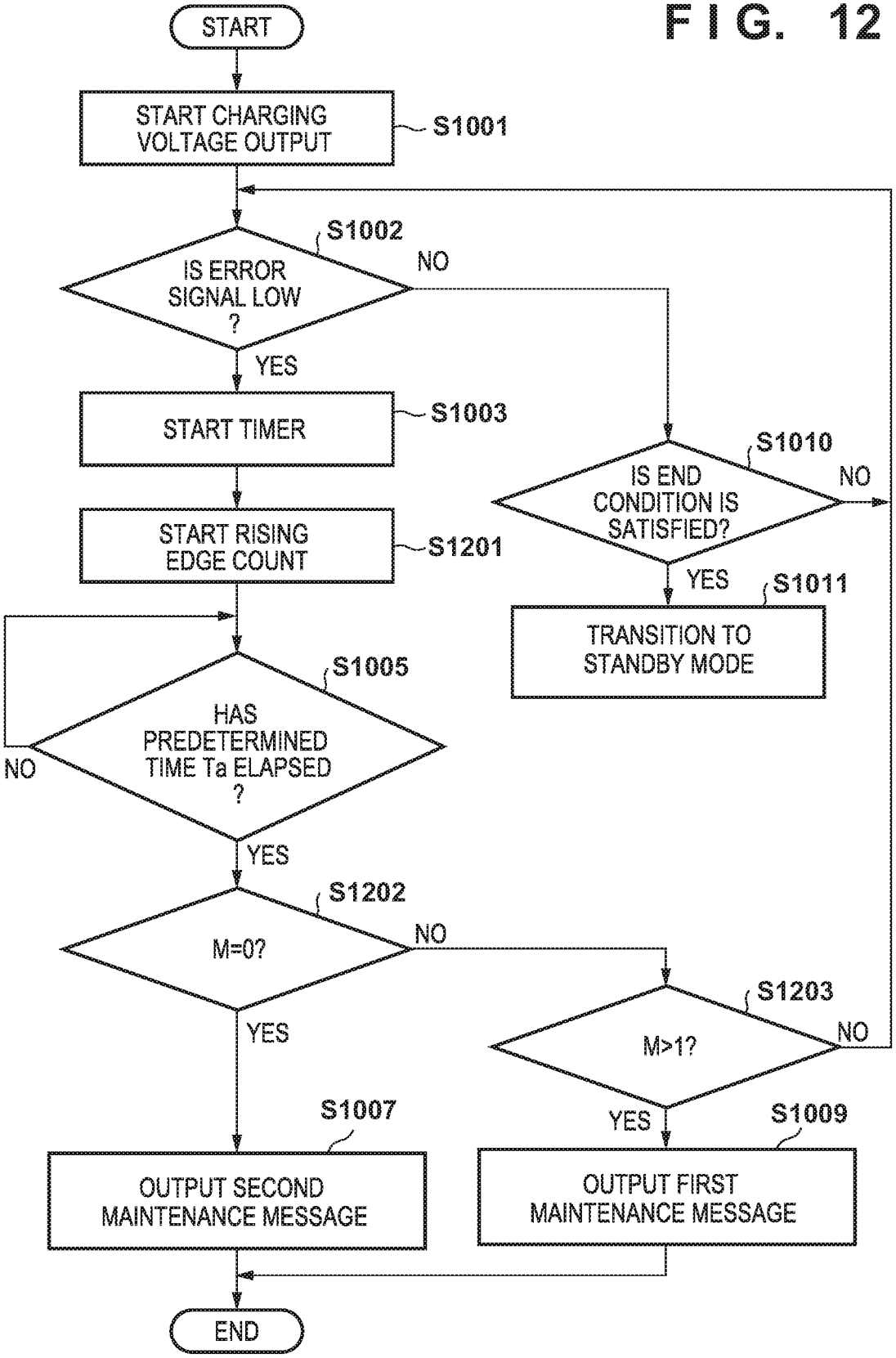
FIG. 12 is a flowchart illustrating signal identification processing.

FIG. 12 is a flowchart illustrating the signal identification processing in Embodiment 2. In Embodiment 2, the steps in common with Embodiment 1 are given the same reference signs. Note that steps S1004, S1006, and S1008 in FIG. 10 are respectively replaced by steps S1201, S1202, and S1203. The CPU 200 advances the processing, after step S1003, to step S1201.

In step S1201, the CPU 200 starts counting rising edges of the error signal ERR. The counter 202 adds 1 to the count value M every time a rising edge is detected. As shown in FIG. 9B, when the error signal ERR falls down, the counter 202 starts counting. In step S1005, the counter 202 continues counting until the timer 201 completes measurement of the predetermined time Ta. When the predetermined time Ta has elapsed, the CPU 200 advances the processing to step S1202.

In step S1202, the CPU 200 (identification section 203) determines whether or not the count value M of the rising edge is 0. As shown in FIG. 9B, if breakage of the wire 28 occurs, the error signal ERR is kept at a low level due to a latch operation of the latch circuit 1100. Therefore, as long as the error signal ERR is the second signal SG2 due to breakage of the wire 28, the count value M is 0. If the count value M is 0, the CPU 200 advances the processing to step S1007. On the other hand, if the count value M is not 0, the CPU 200 (identification section 203) advances the processing to step S1203.

In step S1203, the CPU 200 determines whether or not the count value M of the rising edge exceeds 1. As shown in FIG. 6A, the predetermined time Ta is set, in advance, such that two rising edges caused by leakage will occur. That is, the predetermined time Ta is set such that, if leakage occurs, the count value M exceeds 1. In this way, if the error signal ERR is the first signal SG1, the count value M exceeds 1. In this case, the CPU 200 advances the processing to step S1009. Note that, as shown in FIG. 6B, the count value M of 1 indicates that leakage has disappeared. In this case, the CPU 200 advances the processing to step S1002.

Technical Concept Derived from Embodiments

[Aspect 1]

A process cartridge 5 and the like function as an image forming unit that forms an image on a sheet P. A first generation circuit 213 may generate a first signal relating to a first abnormality regarding a member, in the image forming unit, that is involved in image formation. Also, the first generation circuit 213 is one example of a first generation circuit that generates the first signal indicating that a first maintenance is needed with respect to the member (e.g., wire 28 of post charger 21), in the image forming unit, that is involved in image formation. A second generation circuit 223 may generate a second signal that relates to a second abnormality different from the first abnormality, and whose feature in a time axis direction or a frequency axis direction is different from that of the first signal. The second abnormality is also an abnormality with respect to the member involved in image formation. Also, the second generation circuit 223 is one example of a second generation circuit that generates the second signal indicating that a second maintenance different from the first maintenance is needed with respect to the member, in the image forming unit, which is involved in image formation. The first generation circuit 213 may generate the first signal SG1 indicating that the member involved in image formation is in a first error state. The second generation circuit 223 may generate the second signal indicating that the member involved in image formation is in a second error state different from the first error state. A controller 25 and a CPU 200 are one example of a control circuit having a single port (e.g., input port 210) to which the first signal and the second signal are to be input. The control circuit is configured to identify between the first signal and the second signal based on a feature that is a feature of the signal input to the port and is a feature (e.g., number of pulses or number of rising edges) in a time axis direction or a frequency axis direction. Accordingly, an image forming apparatus that can distinguish between two detection signals relating to maintenance of the image forming apparatus is provided.

[Aspect 2]

As shown in FIGS. 6A, 9A, and the like, the period of the first signal may be different from the period of the second signal. The control circuit may easily distinguish between the first signal and the second signal by focusing on the difference between the period of the first signal and the period of the second signal. The period of the first signal may be longer than the period of the second signal, or the period of the first signal may be shorter than the period of the second signal.

[Aspect 3]

The control circuit may include a counter 202 that counts one of a falling edge and a rising edge of a signal input to the port. The control circuit may include a timer 201 that, upon a signal being input to the port, starts measuring time, and the counter 202 that counts one of a falling edge and a rising edge of the signal input to the port until the timer 201 completes measuring a predetermined time Ta. An identification section 203 is one example of an identification circuit that distinguishes between the first signal and the second signal based on a count value (e.g., number of rising edges M) of the counter 202. It is possible to distinguish between the first signal and the second signal with a relatively simple configuration as described above.

[Aspect 4]

As shown in FIGS. 6A, 9A, and the like, the first signal and the second signal may each be a pulse signal. In this case, the number of pulses per unit time with respect to the first signal is different from the number of pulses per unit time with respect to the second signal. With this, the first signal and the second signal may be identified.

[Aspect 5]

The control circuit may include a counter 202 that counts the number of pulses of a signal input to the port. The counter 202 may count the number of pulses of a signal input to the port until a timer has completed measuring a predetermined time. The identification section 203 is one example of an identification circuit that distinguishes between the first signal and the second signal based on the count value (e.g., number of pulses N) of the counter 202. It is possible to distinguish between the first signal and the second signal with a relatively simple configuration as described above.

[Aspect 6]

An AC power supply circuit 211 is one example of an AC power supply circuit that generates an AC voltage according to a driving signal (e.g., CLK_A, CLK_B) output from the control circuit, and supplies the AC voltage to a load. The first generation circuit 213 may include an AC detection circuit 212 that detects a current to be supplied to the load, and a signal generation circuit (e.g., comparator IC300) that, upon an overcurrent being detected by the AC current detection circuit, generates the first signal. An overcurrent protection circuit 500 is one example of a first restricting circuit that, upon an overcurrent being detected by the AC current detection circuit, restricts the operation of the AC power supply circuit. It is possible to protect the wire 28 and the power supply apparatus 26 from an overcurrent while detecting the necessity of cleaning the wire 28 as described above.

[Aspect 7]

The first restricting circuit may also be a circuit that allows and cuts off the supply of the driving signal from the control circuit to the AC power supply circuit. For example, similarly to the overcurrent protection circuit 500, the first restricting circuit may allow and cut off the supply of the driving signals CLK_A and CLK_B. Accordingly, the wire 28 and the power supply apparatus 26 can be protected from an overcurrent.

[Aspect 8]

A DC power supply circuit 221 is one example of a DC power supply circuit that generates a DC voltage according to a driving signal output from the control circuit, and supplies the DC voltage to a load. The second generation circuit may include a DC detection circuit (e.g., 222) that detects a DC current or a DC voltage that is supplied from the DC power supply circuit to the load. A comparator IC400 or the like may function as a signal generation circuit that, upon an overvoltage being detected by the DC detection circuit, generates the second signal. An overvoltage protection circuit 700 may function as a second restricting circuit that, upon an overvoltage being detected by the DC detection circuit, restricts the operation of the DC power supply circuit. Accordingly, the DC power supply circuit 221 can be protected from the overvoltage.

[Aspect 9]

The second restricting circuit such as the overvoltage protection circuit 700 may be a circuit that allows and cuts off the supply of the driving signal from the control circuit to the DC power supply circuit. For example, the overvoltage protection circuit 700 may allow and cut off the supply of the driving signal CLK_C. Accordingly, the power supply apparatus 26 can be protected from the overvoltage.

[Aspect 10]

The second restricting circuit may be a circuit that cuts off the supply of the driving signal from the control circuit to the DC power supply circuit. For example, the overvoltage protection circuit 700 may cut off the supply of the driving signal CLK_C. Accordingly, the power supply apparatus 26 can be protected from the overvoltage.

[Aspect 11]

As described in Embodiment 2, the second restricting circuit may include a latch circuit 1100 that, upon an overvoltage being detected by the DC detection circuit, continues cutting off the supply of the driving signal from the control circuit to the DC power supply circuit. If the wire 28 is broken, the post charger 21 needs to be replaced. Therefore, as a result of the supply of the driving signal being kept cut off, the power supply apparatus 26 can be protected from the overvoltage, in a stable period.

[Aspect 12]

A member involved in the image formation may be a charger (e.g., post charger 21) for keeping the charge amount of toner that is carried by a photoreceptor at a charge amount in a target range. Accordingly, maintenance of the charger may be appropriately executed.

[Aspect 13]

The first signal may be a signal indicating that a first maintenance is needed. In this case, the first maintenance may be cleaning of the charger. For example, if a paper scrap or the like is attached to the wire 28, a leakage current occurs. Therefore, as a result of cleaning the wire 28, the leakage current may disappear.

[Aspect 14]

The first signal SG1 may also be a signal indicating that a leakage current has occurred regarding a wire that is provided in the charger and charges the image carrier with corona discharge. Accordingly, the control circuit may recognize that a leakage current has occurred regarding the wire 28.

[Aspect 15]

The second signal may be a signal indicating that a second maintenance is needed. In this case, the second maintenance may be repair or replacement of the charger. For example, if the wire 28 is broken, the post charger 21 needs to be repaired or replaced. Therefore, as a result of the post charger 21 being repaired or replaced, the image forming apparatus 100 may again be able to form an image.

[Aspect 16]

The second signal SG2 may also be a signal indicating that the wire 28 that is a wire provided in the charger and charges an image carrier with corona discharge is broken. Accordingly, the control circuit may recognize that the wire 28 is broken.

[Aspect 17]

The first generation circuit may include a first time constant circuit that determines the period of the first signal. As shown in FIG. 5, the first time constant circuit may be constituted by a capacitor C304 and resistors R304' and R303. Accordingly, the period of the first signal may be determined relatively stably.

[Aspect 18]

The second generation circuit may include a second time constant circuit that determines the period of the second signal. The second time constant circuit may be constituted by a capacitor C404 and resistors R405 and R406. Accordingly, the period of the second signal may be determined relatively stably.

[Aspect 19]

A notification section 204 and a display apparatus 27 may function as an output unit that outputs a first message (e.g., first maintenance message) or a second message (e.g., second maintenance message). The output unit, upon the identification circuit identifying the first signal, outputs a first message corresponding to the first signal. The output unit, upon the identification circuit identifying the second signal, outputs a second message corresponding to the second signal. Accordingly, a user or a maintenance staff member may easily understand what maintenance is needed.

[Aspect 20]

A charging roller 2 is one example of a charging unit that charges an image carrier. A power supply apparatus 26 functions as a power supply unit that supplies a charging voltage in which an AC voltage is superimposed on a DC voltage to the charging unit. A first generation circuit 213 may detect a first abnormality regarding the DC voltage, in the power supply unit, and may, upon detecting the first abnormality, generate a first signal having a first pattern. The second generation circuit 223 may detect a second abnormality regarding the AC voltage, in the power supply unit, and may, upon detecting the second abnormality, generate a second signal having a second pattern that is different from the first pattern. The controller 25 and the CPU 200 are one example of the control circuit having a single port to which the first signal and the second signal are to be input. The controller 25 and the CPU 200 may distinguish between the first signal and the second signal based on the pattern of a signal input to the port.

In Embodiments 1 and 2, the number of pulses or the number of rising edges of an error signal ERR in a predetermined time T1 is counted, but the pulse period in the error signal ERR may be measured. In Embodiments 1 and 2, the power supply apparatus 26 includes the AC power supply circuit 211 and the DC power supply circuit 221. However, the power supply apparatus 26 may also include a power supply circuit that generates a charging voltage Vout constituted only by an AC component. Also, the power supply apparatus 26 may also include a power supply circuit that generates a charging voltage Vout constituted only by a DC component. The first generation circuit 213 and the second generation circuit 223 can be applied to these cases as well.

Also, the second maintenance message is a message that indicates or suggests breakage of the wire 28, but may include information indicating that disconnection has occurred in a power feeding path from an output unit of the power supply apparatus 26 to the post charger 21. It is because, if a nonconductive portion is present at any point in the power feeding path, the second signal SG2 may be generated similarly to the breakage of the wire 28.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-137079, filed Jul. 25, 2019 which is hereby incorporated by reference herein in its entirety.

What is claimed is:

1. An image forming apparatus comprising:

an image forming unit that forms an image on a sheet;

a first generation circuit that generates, regarding a member involved in image formation in the image forming unit, a first signal relating to a first abnormality;

a second generation circuit that generates, regarding the member, a second signal that relates to a second abnormality different from the first abnormality, and whose feature in a time axis direction or a frequency axis direction is different from that of the first signal; and a control circuit having a single port to which the first signal and the second signal are to be input, wherein the control circuit is configured to identify between the first signal and the second signal based on a feature of a signal input to the port.

2. The image forming apparatus according to claim 1, wherein a period of the first signal is different from a period of the second signal.

3. The image forming apparatus according to claim 2, wherein the control circuit includes:

a counter that counts one of a falling edge and a rising edge of a signal input to the port; and an identification circuit that distinguishes between the first signal and the second signal based on a count value of the counter.

4. The image forming apparatus according to claim 1, wherein the first signal and the second signal are each a pulse signal, and wherein a number of pulses per unit time with respect to the first signal is different from a number of pulses per unit time with respect to the second signal.

5. The image forming apparatus according to claim 4, wherein the control circuit includes:

a counter that counts a number of pulses of a signal input to the port; and an identification circuit that distinguishes between the first signal and the second signal based on a count value of the counter.

6. The image forming apparatus according to claim 1, further comprising:

an AC power supply circuit that generates an AC voltage according to a driving signal output from the control circuit, and supplies the AC voltage to a load, wherein the first generation circuit includes:

an AC detection circuit that detects a current supplied to the load;

a signal generation circuit that, upon an overcurrent being detected by the AC detection circuit, generates the first signal; and a first restricting circuit that, upon an overcurrent being detected by the AC detection circuit, restricts the operation of the AC power supply circuit.

7. The image forming apparatus according to claim 6, wherein the first restricting circuit is a circuit that allows and cuts off the supply of the driving signal from the control circuit to the AC power supply circuit.

8. The image forming apparatus according to claim 1, further comprising:

a DC power supply circuit that generates a DC voltage according to a driving signal output from the control circuit, and supplies the DC voltage to a load, wherein the second generation circuit includes:

a DC detection circuit that detects a DC voltage that is supplied from the DC power supply circuit to the load;

a signal generation circuit that, upon an overvoltage being detected by the DC detection circuit, generates the second signal; and a second restricting circuit that, upon an overvoltage being detected by the DC detection circuit, restricts the operation of the DC power supply circuit.

9. The image forming apparatus according to claim 8, wherein the second restricting circuit is a circuit that allows and cuts off the supply of the driving signal from the control circuit to the DC power supply circuit.

10. The image forming apparatus according to claim 8, wherein the second restricting circuit is a circuit that cuts off the supply of the driving signal from the control circuit to the DC power supply circuit.

11. The image forming apparatus according to claim 10, wherein the second restricting circuit includes a latch circuit that, upon an overvoltage being detected by the DC detection circuit, continues cutting off the supply of the driving signal from the control circuit to the DC power supply circuit.

12. The image forming apparatus according to claim 1, wherein a member involved in image formation is a charger for keeping a charge amount of toner that is carried by a photoreceptor at a charge amount in a target range.

13. The image forming apparatus according to claim 12, wherein the first signal is a signal indicating that a first maintenance is needed, and the first maintenance is cleaning of the charger.

14. The image forming apparatus according to claim 12, wherein the first signal is a signal indicating that a leakage current has occurred regarding a wire that is provided in the charger and charges the photoreceptor with corona discharge.

15. The image forming apparatus according to claim 12, wherein the second signal is a signal indicating that a second maintenance is needed, and the second maintenance is repair or replacement of the charger.

16. The image forming apparatus according to claim 15, wherein the second signal is a signal indicating that a wire that is provided in the charger and charges the photoreceptor with corona discharge is broken.

17. The image forming apparatus according to claim 1, wherein the first generation circuit includes a first time constant circuit that determines a period of the first signal.

18. The image forming apparatus according to claim 1, wherein the second generation circuit includes a second time constant circuit that determines a period of the second signal.

19. The image forming apparatus according to claim 1, further comprising an output unit that, upon the control circuit identifying the first signal, outputs a first message corresponding to the first signal, and upon the control circuit identifying the second signal, outputs a second message corresponding to the second signal.

20. An image forming apparatus comprising:

a charging unit that charges an image carrier;

an image forming unit that forms a toner image on the image carrier charged by the charging unit;

a power supply unit that supplies a charging voltage in which an AC voltage is superimposed on a DC voltage to the charging unit;

a first generation circuit that detects a first abnormality regarding the DC voltage, in the power supply unit, and upon detecting the first abnormality, generates a first signal having a first pattern;

a second generation circuit that detects a second abnormality regarding the AC voltage, in the power supply unit, and upon detecting the second abnormality, generates a second signal having a second pattern that is different from the first pattern; and a control circuit having a single port to which the first signal and the second signal are to be input, wherein the control circuit is configured to distinguish between the first signal and the second signal based on a pattern of a signal input to the port.

* * * * *